US006299530B1

(12) United States Patent
Hansted et al.

(10) Patent No.: US 6,299,530 B1
(45) Date of Patent: Oct. 9, 2001

(54) INTEGRATED TRANSACTION CARD AND PACKAGING

(76) Inventors: Kenneth W. Hansted, 254 W. 51st St., #17B, New York, NY (US) 10019; Allan W. Hansted, 2525 Covered Bridge La., Allentown, PA (US) 18104; Phil Welsher, 27 Sturwood Dr., Belle Mead, NJ (US) 08502

( * ) Notice: Subject to any disclaimer, the term of this patent is extended or adjusted under 35 U.S.C. 154(b) by 0 days.

(21) Appl. No.: 09/072,837

(22) Filed: May 5, 1998

(51) Int. Cl.[7] ..... B41L 1/20

(52) U.S. Cl. ..... 462/64; 206/449; 229/92; 229/300; 281/2; 281/5; 283/116

(58) Field of Search ..... 281/2, 5, 7, 9, 281/10, 12, 14; 283/61, 62, 116; 462/64, 65; 206/449, 466; 229/92.1, 92, 300

(56) References Cited

U.S. PATENT DOCUMENTS

| | | | | |
|---|---|---|---|---|
| 4,010,964 | * | 3/1977 | Schechter | 283/62 |
| 4,212,231 | | 7/1980 | Penick et al. | 93/1 |
| 4,890,862 | * | 1/1990 | Buchholz | 283/62 |
| 5,114,067 | * | 5/1992 | Martin et al. | 229/92.1 |
| 5,341,930 | | 8/1994 | Counts et al. | 206/459.5 |
| 5,458,284 | | 10/1995 | Haan et al. | 229/304 |
| 5,464,255 | * | 11/1995 | Schildmeyer | 283/116 |
| 5,489,123 | | 2/1996 | Roshkoff | 283/81 |
| 5,495,981 | | 3/1996 | Warther | 229/71 |
| 5,547,225 | * | 8/1996 | DeAngelis | 402/79 |
| 5,626,286 | * | 5/1997 | Petkovsek | 229/300 |
| 5,630,627 | * | 5/1997 | Stewart | 283/81 |
| 5,664,725 | * | 9/1997 | Walz | 229/92 |
| 5,667,247 | | 9/1997 | Ramsburg et al. | 283/61 |
| 5,684,291 | | 11/1997 | Taskett | 235/487 |
| 5,730,056 | | 3/1998 | Schmitt | 101/232 |
| 5,752,647 | * | 5/1998 | Schubert et al. | 229/92.1 |

* cited by examiner

*Primary Examiner*—A. L. Wellington
*Assistant Examiner*—Monica S. Carter
(74) *Attorney, Agent, or Firm*—Gary J. Gershik; Cooper & Dunham LLP

(57) ABSTRACT

Described is an integrated transaction card and packaging assembly, such as for telephone cards. The packaging may be a co-op type packaging in that it includes promotional material, such as coupons, in addition to the transaction card.

4 Claims, 21 Drawing Sheets

INTEGRATED TRANSACTION CARD AND PACKAGING

BACKGROUND OF THE INVENTION

This invention pertains to an integrated transaction card and packaging assembly, such as for telephone cards. The packaging may be a co-op type packaging in that it includes promotional material, such as coupons, in addition to the transaction card. The packaging may be adapted for use in stores, as magazine inserts, direct mail items, etc.

A substantial market has developed in recent years for inexpensively manufactured, individually encoded transaction cards such a telephone cards, credit cards, membership cards and I.D. cards. While the manufacture and coding of the individual cards may be simple, distribution of the cards required individual packaging which was a multistep, labor intensive process.

The packaging of transaction cards required several labor intensive steps and coordination of several independent processes. For example, the card was produced by on printer while the package was produced by another printer, often at different geographic locations. Some types of packaging consist of multiple elements, which may need to be independently produced, thus adding to the number of total steps. Then the card and packaging was brought together, often at a third location, where insertion of the card into the packaging took place.

The problems of the prior art transaction card packaging are evident. Because the transaction cards and their packaging must be printed separately, more time is needed to complete production if the same printer is used to print both the card and the packaging. Alternatively, several printers must be used to simultaneously print the cards and the packaging. In addition, both methods require the extra step of insertion of the card into the packaging.

Sometimes, companies wish to provide incentives for transaction card purchasers, such as additional cards or coupons from a different company. Where products of more than one company are involved, the practice is referred to as co-op packaging. In such a case, insertion of the coupon or second card adds a further step to the total process. Moreover, insertion of the coupon or second card requires a level of coordination that is difficult to achieve with automated means. Thus, assembly by hand may be required in some cases.

The present invention provides an integrated transaction card and packaging system which overcomes the problems of prior art transaction card packaging methods. In addition, the inventive packaging system design lends itself well to multiple card and co-op type packaging.

SUMMARY OF THE INVENTION

The integrated card and packaging assembly of this invention comprises a contiguous sheet of material having at least one integrally formed manually detachable card. The contiguous sheet is folded thus forming a package for the card.

DETAILED DESCRIPTION OF THE INVENTION

Figure 1A:
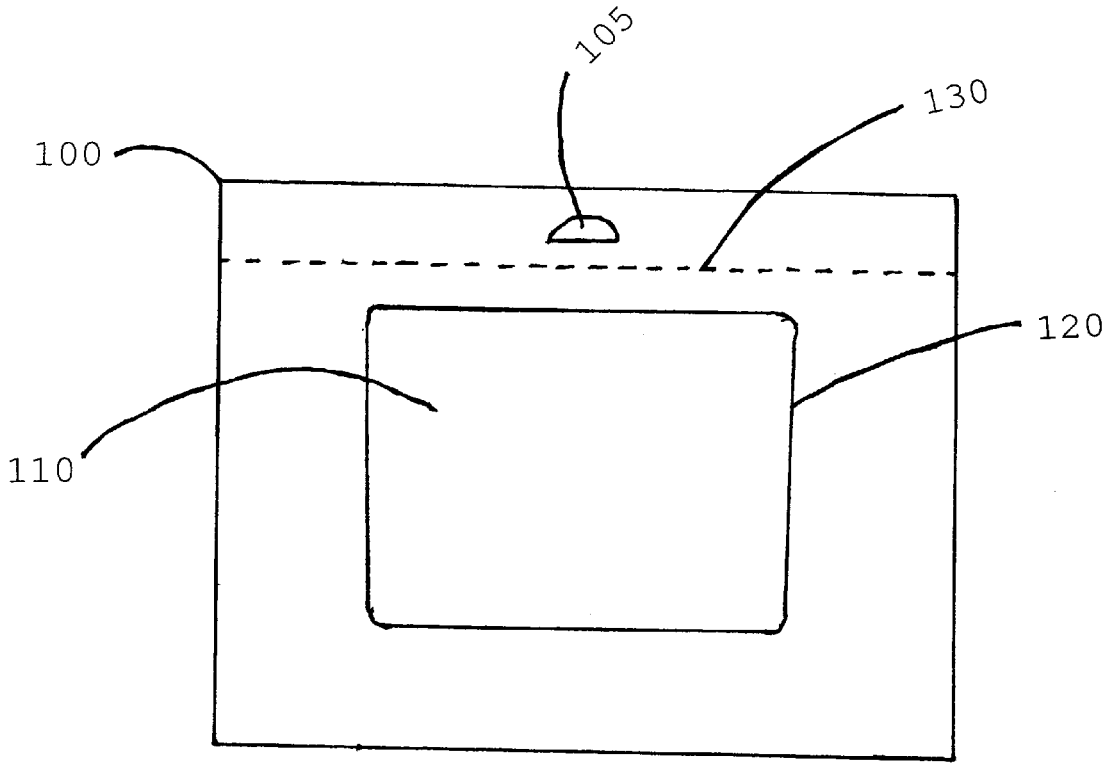
FIGS. 1*a*–1*d* are schematic illustration of one embodiment of the integrated card and packaging according to this invention, and a line diagram for its fabrication.

In the first three embodiments of this invention, the integrated card and packaging assembly comprises a contiguous sheet of material having at least one integrally formed manually detachable card. The contiguous sheet is folded to form a package for the card.

The contiguous sheet may have an opening through which one side of the card is visible when the contiguous sheet is folded. The opening may be covered by a patch of transparent material such as polyvinyl, for example.

For co-op packaging designs, the contiguous sheet may also have perforated sections defining integrally formed coupon panels. The perforations make the coupons manually detachable by the customer.

The card section of these designs may be made of more than one layer of the material of the contiguous sheet, thus being stiffer than the contiguous sheet. The card section is formed from the contiguous sheet and remains attached to the contiguous sheet at least on one of its four edges. Perforations at the edge of attachment hold the card attached to the contiguous sheet, while allowing the customer to easily and cleanly detach the card from the contiguous sheet.

In the fourth embodiment the integrated card and packaging assembly comprises a back panel having a front side and a back side; a card panel attached to the front side of the back panel and having a front side, a back side and a card section; a cover panel attached to the front side of the card panel and having a section outlined by perforation to constitute a flap larger in area than the area of the card.

The flap in the cover panel may have a window die cut within it and disposed to make the card section of the card panel visible.

This embodiment may comprise a second card panel disposed between the card panel and the cover panel. The second card panel may be used to enhance the stiffness of the card section of this assembly.

Each card panel of this embodiment may also have a coupon section formed therein. Where more than one card panel is used and each has a coupon section, numerous coupons may be packaged in a booklet type format, i.e. one coupon on a first page, a second coupon on a second page, etc., each page being the coupon section of each card panel.

In all embodiments, the card or the coupons or both may be coded during processing. For example, the card may have a unique number imaged on it during processing, then a barrier coating may be formed over the imaged number, and a scratch-off panel may be formed over the barrier coating.

The materials used in this invention are widely know in the art and available to the skilled artisan. The material of the contiguous sheet or each individual panel can be selected according to the final use of the packaging. For most applications, 80 pound matte coated text can be used as the substrate.

The fabrication of the integrated card and packaging of this invention may be performed by conventional equipment, configured, of course, to fabricate the inventive assemblies. It is preferred to use a web roll printer with the appropriate number and the appropriate configuration of plow folding units, die cutting units, pattern gluers and bead-line gluers.

DETAILED DESCRIPTION OF THE DRAWINGS

FIG. 1*a* is the front face view of the final form of the first embodiment of this invention. The package 100 has a window opening 120 through which the card 110 is visible, a hanger hole 105, and a perforation 130 for opening the package and accessing the card.

Figure 1B:
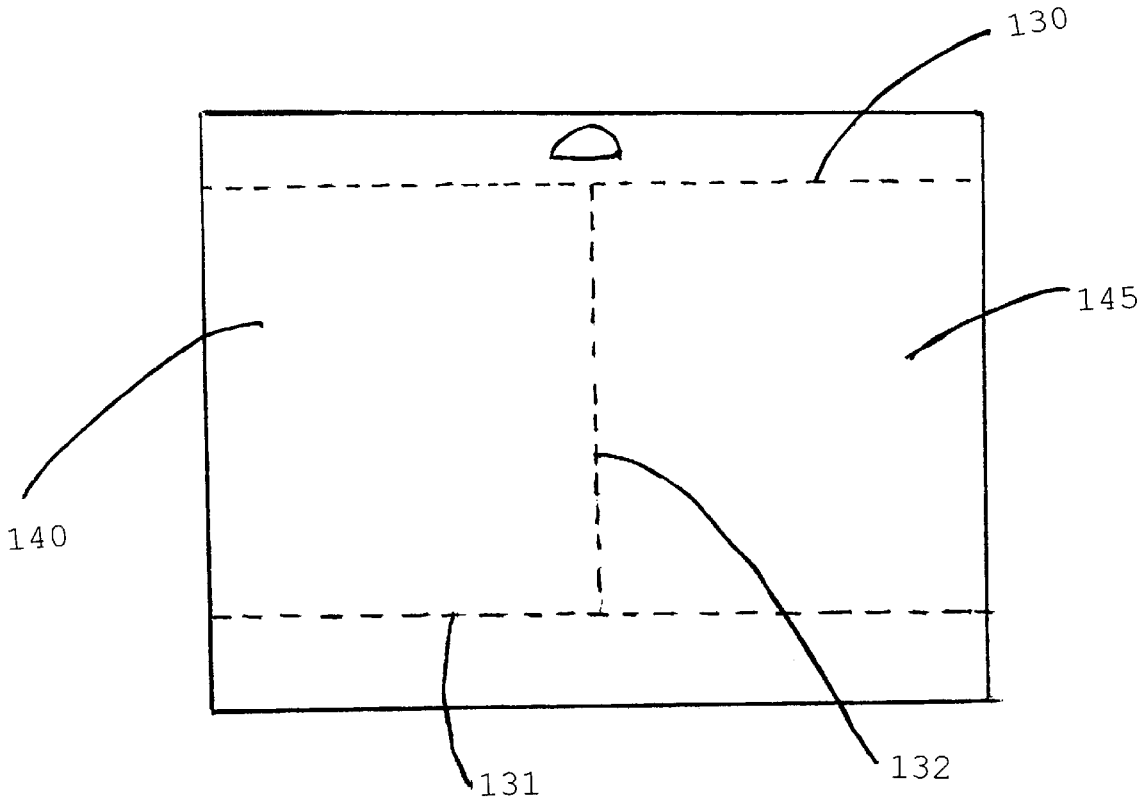

FIG. 1*b* is the rear view of the same package having two coupon sections 140 and 145, and perforations 130, 131 and 132 for detaching the coupons. More than two coupons sections may be present or only one or none at all, as required by the specific application.

Figure 1C:
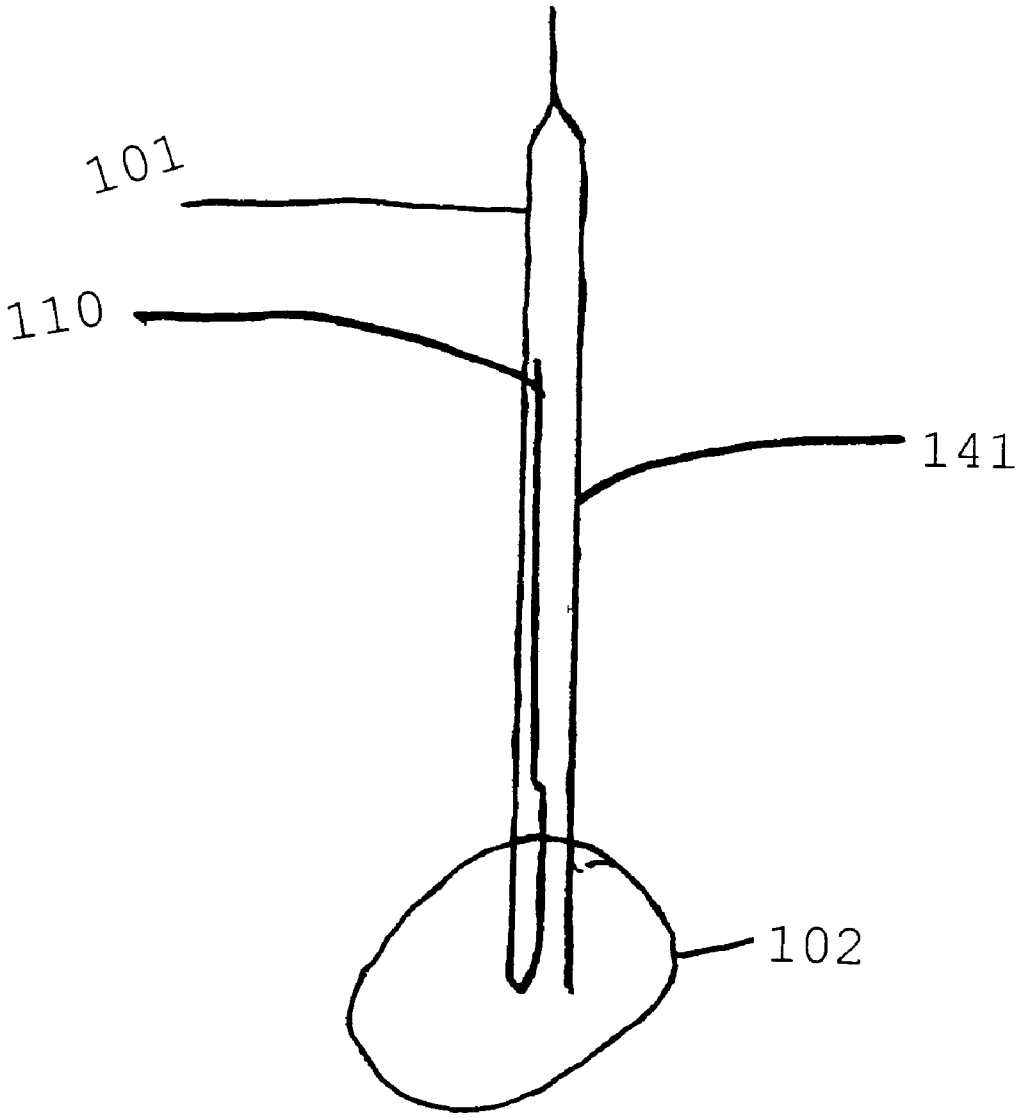

FIG. 1*c* is an exaggerated side view showing the card 110 disposed in between the back panel 141, which may have the coupon sections 140 and 145, and the front panel 101 which has the window 120. This depiction is exaggerated because in section 102 the panels are not shown as being attached for clarity of the design using a contiguous sheet. However, the panels would be attached, for example by glue, in section 102.

Figure 1D:
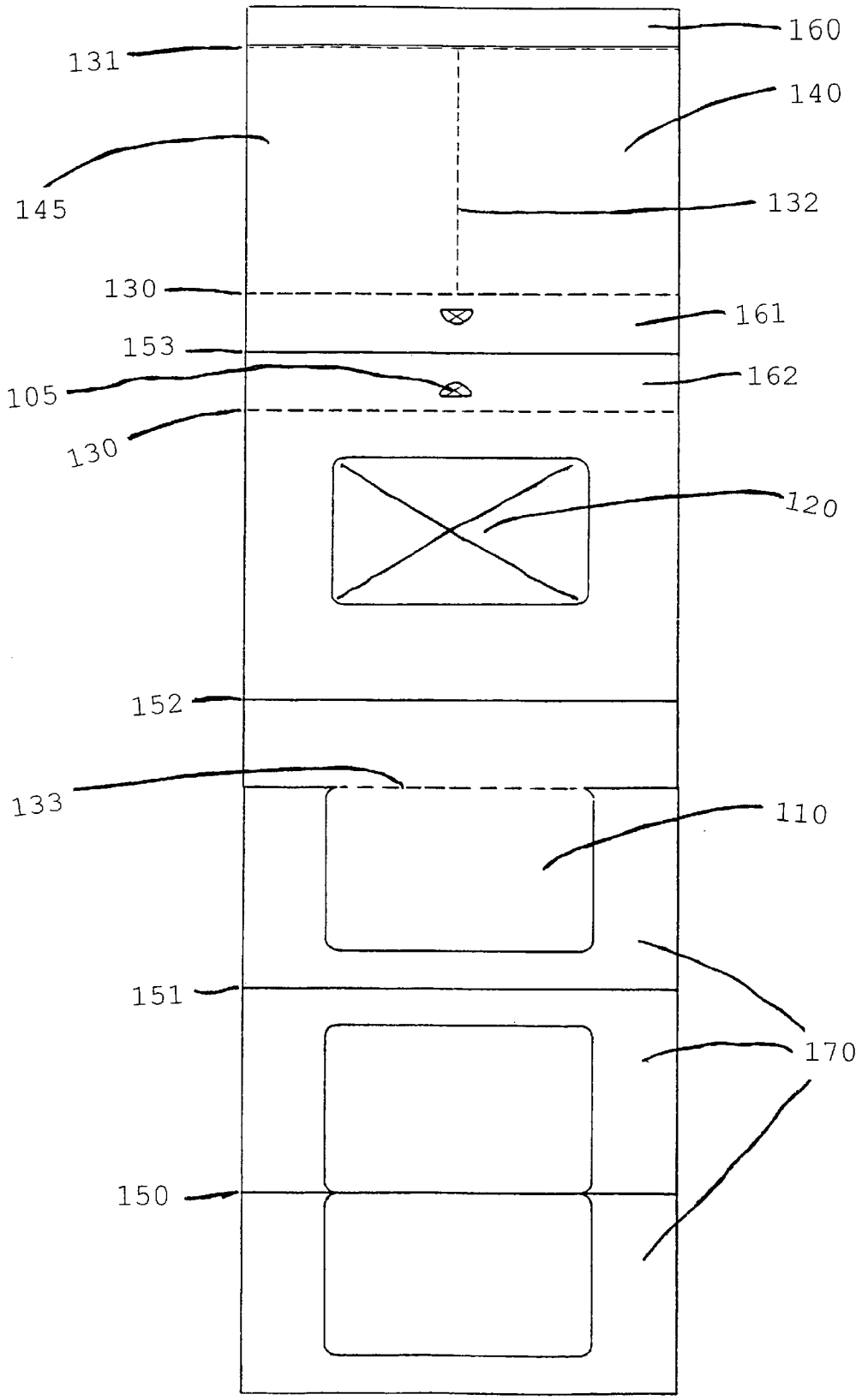

FIG. 1*d* is a line diagram for manufacturing the first embodiment of the invention from one contiguous sheet. Three sections of the contiguous sheet are folded over each other along plow lines 150 and 151 to form a section of triple thickness. Sections 170 are die cut and removed thus forming a card section 110 having a stiffness greater than the rest of the sheet because of its triple thickness. The edge attaching the card to the contiguous sheet has a perforation 133 to facilitate removal of the card by the customer. The contiguous sheet is folded along plow lines 152 and 153 then glued at areas 160, 161 and 162 to form the final package.

Figure 2A:
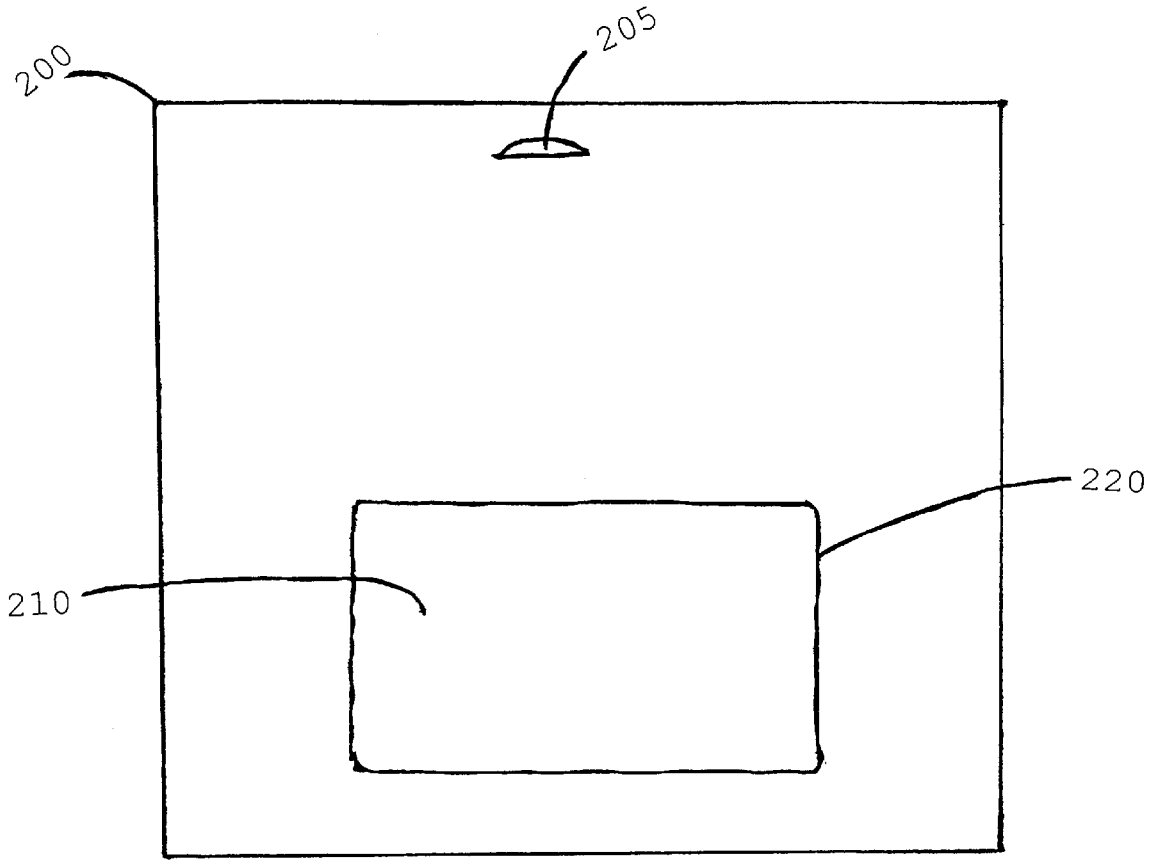
FIGS. 2*a*–2*f* are schematic illustration of a second embodiment of the integrated card and packaging according to this invention, and line diagrams for its fabrication.

FIG. 2*a* is the front face view of the final form of the second embodiment of this invention. The package 200 has a window opening 220 through which the card 210 is visible and a hanger hole 205.

Figure 2B:
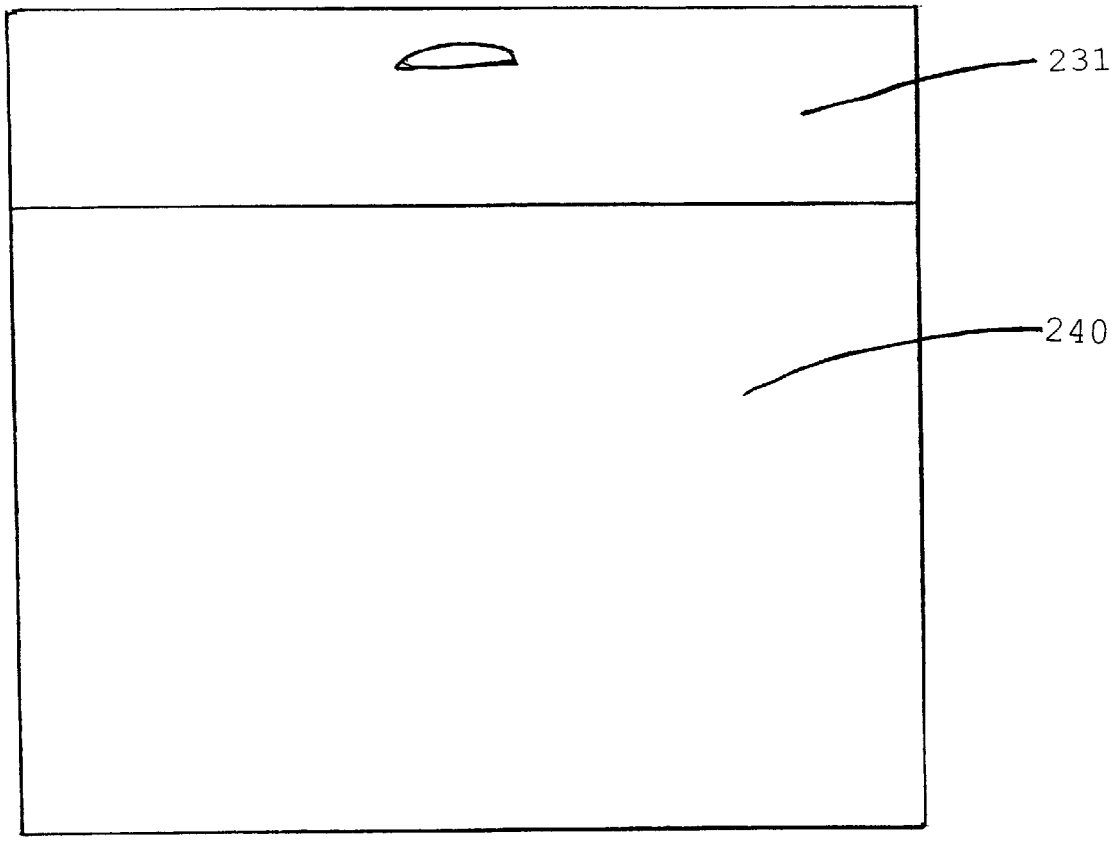

FIG. 2*b* is the rear view of the same package having a coupon section 240 attached to back panel 231. The coupon section may be divided into numerous smaller coupon section or none at all, as required by the specific application.

Figure 2C:
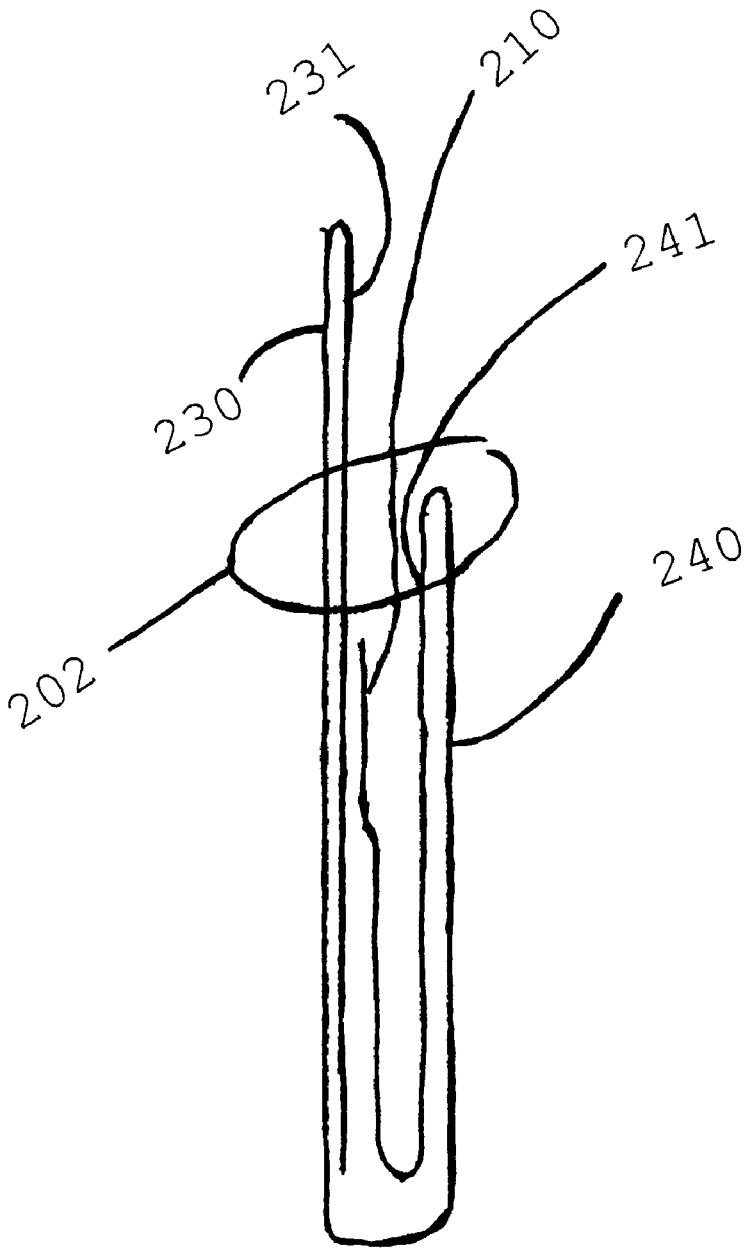

FIG. 2*c* is an exaggerated side view showing the card 210 disposed in between the back panel 231 of the front of the package and the second coupon panel 241. No points of attachments are shown in this figure for clarity of the design using a contiguous sheet. However, the panels would be attached, for example by clean release glue, in section 202.

Figure 2D:
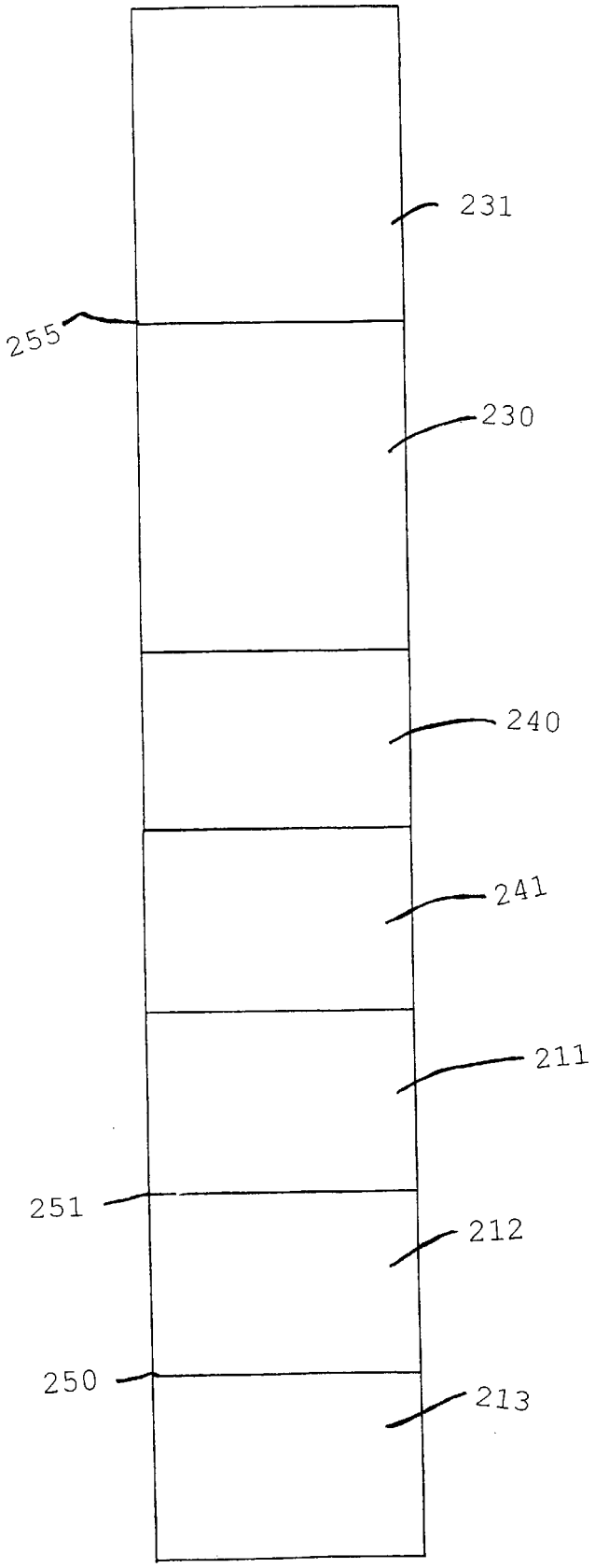
Figure 2E:
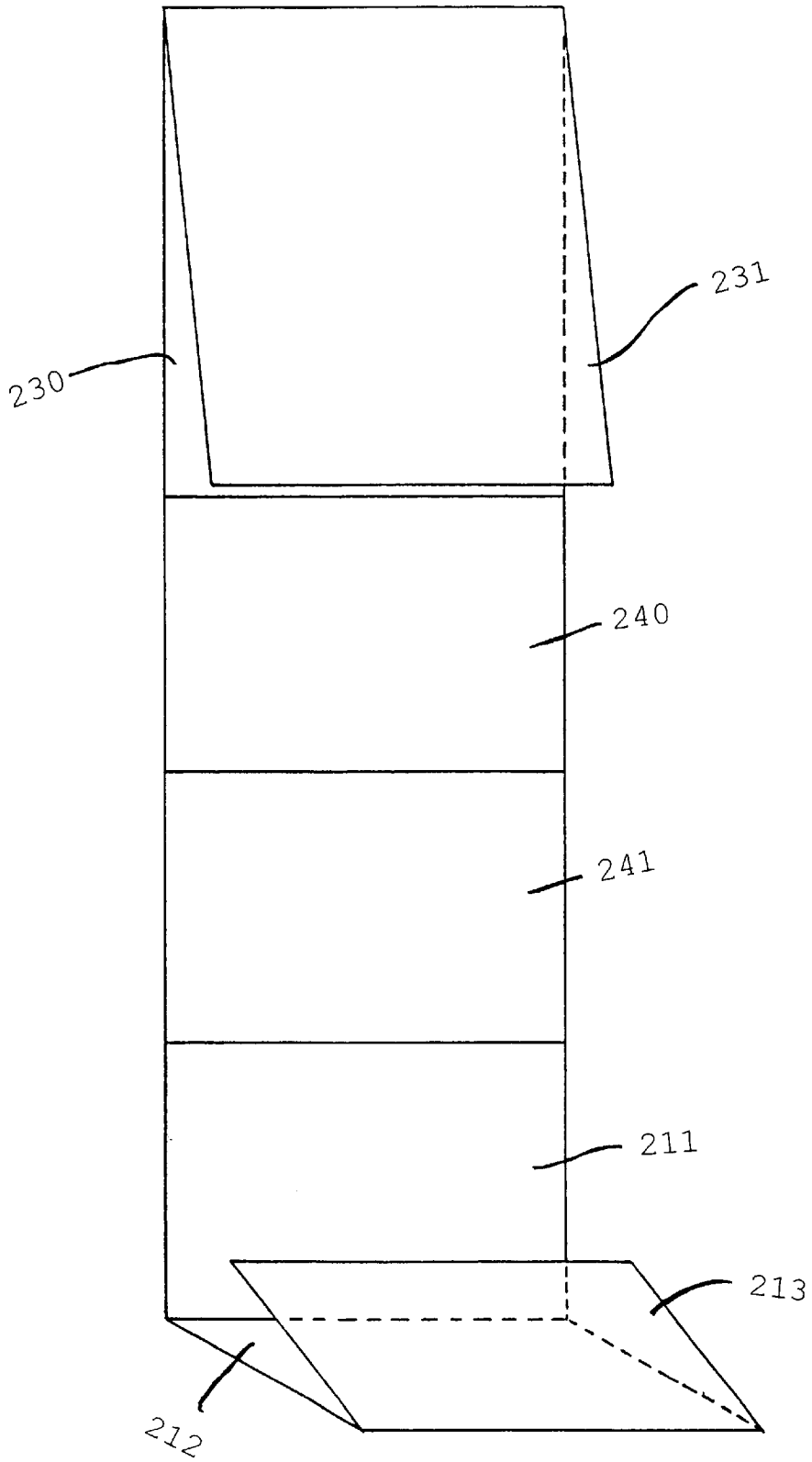
Figure 2F:
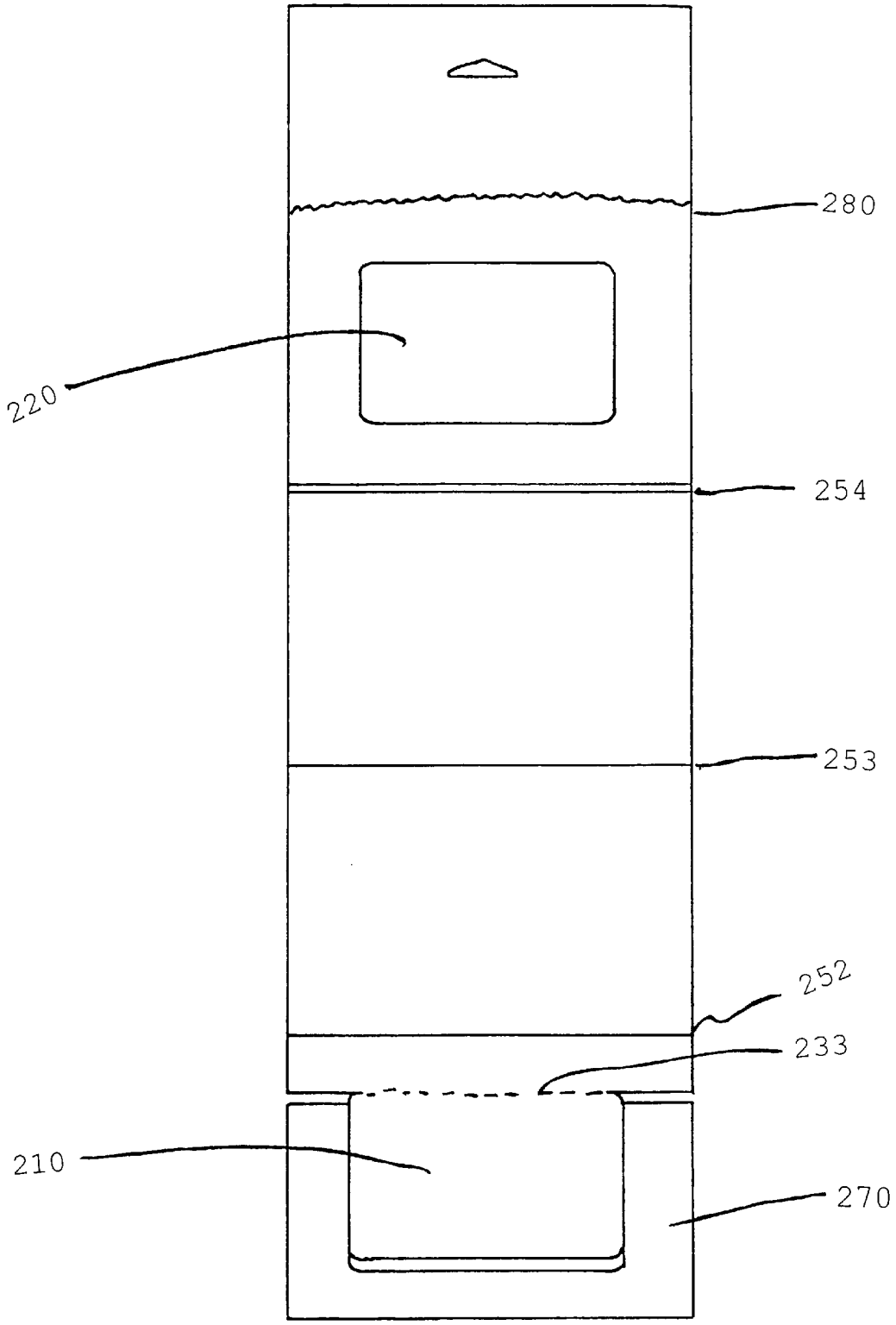

FIGS. 2*d*–2*f* are line diagrams for fabricating the second embodiment of the invention from one contiguous sheet. Three sections 211, 212 and 213 of the contiguous sheet are folded over each other along plow lines 250 and 251 to form a section of triple thickness. More or less sections may be folded over depending on the thickness desired. Section 270 is die cut and removed thus forming a card section 210 having a stiffness greater than the rest of the sheet because of its triple thickness. The edge attaching the card to the contiguous sheet has a perforation 233 to facilitate removal of the card by the customer.

The contiguous sheet is folded along plow lines 252, 253 and 254. The front of the package is formed from a cover panel 230 and a back panel 231 folded over each other along plow line 255. Plow lines 252, 253 and 254 may be perforated if panels 240 and 241 are coupons to allow for easy separation of the coupons. The package is sealed by a line of clean release glue 280.

Figure 3A:
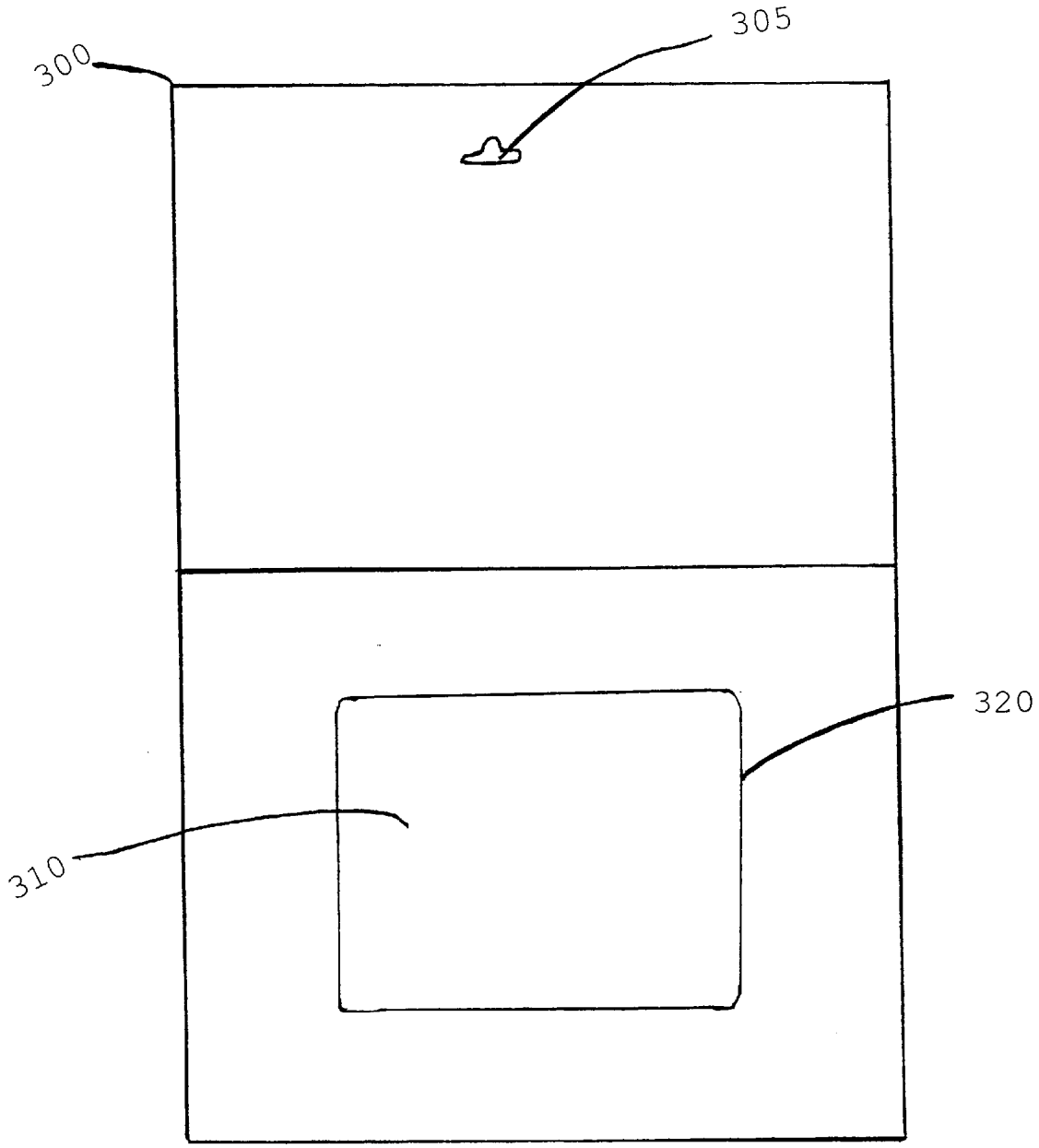
FIGS. 3*a*–3*f* are schematic illustration of a third embodiment of the integrated card and packaging according to this invention, and line diagrams for its fabrication.

FIG. 3*a* is the front face view of the final form of the third embodiment of this invention. The package 300 has a window opening 320 through which the card 310 is visible and a hanger hole 305.

Figure 3B:
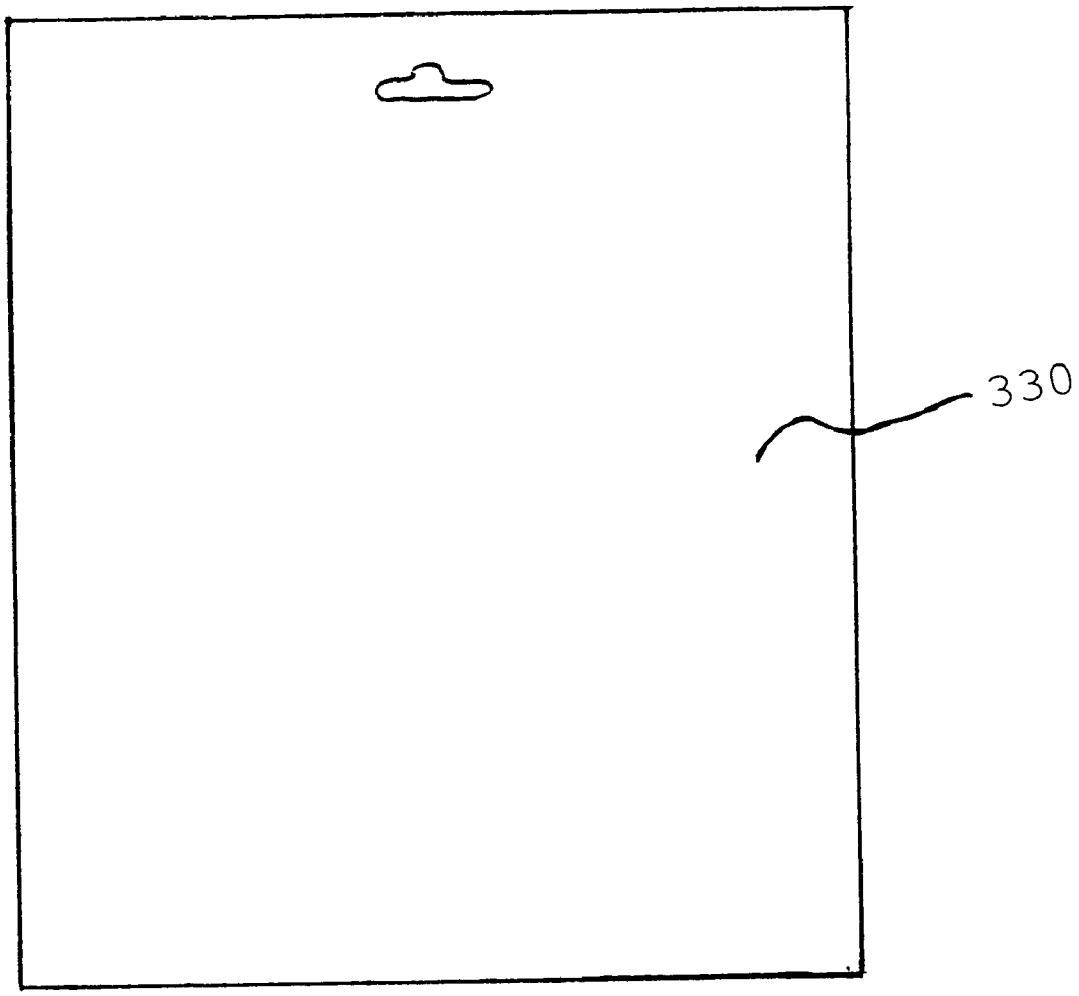

FIG. 3*b* is the rear view of the same package. The back panel 330 is the only panel visible in this design. The back panel may have coupons and the corresponding perforations.

Figure 3C:
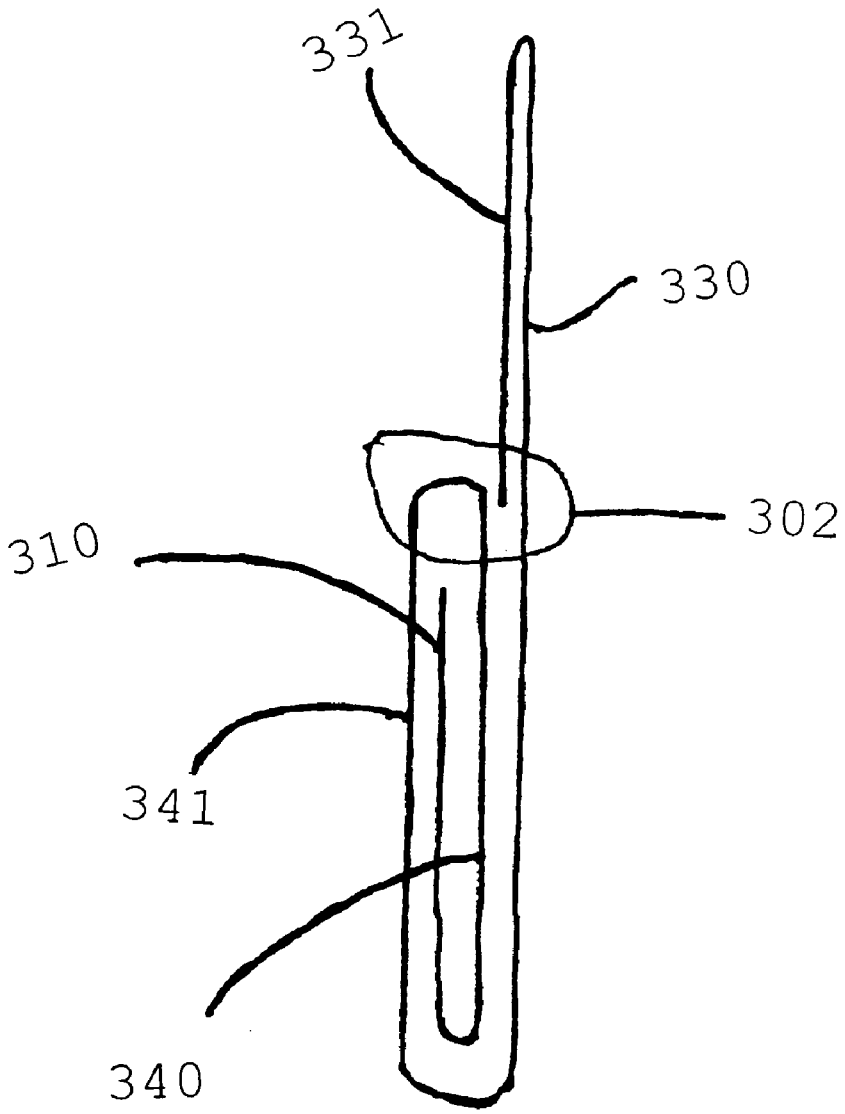

FIG. 3*c* is an exaggerated side view showing the card 310 disposed in between the optional coupon panels 340 and 341. No points of attachments are shown in this figure for clarity of the design using a contiguous sheet. However, the panels would be attached, for example by clean release glue, in section 302.

Figure 3D:
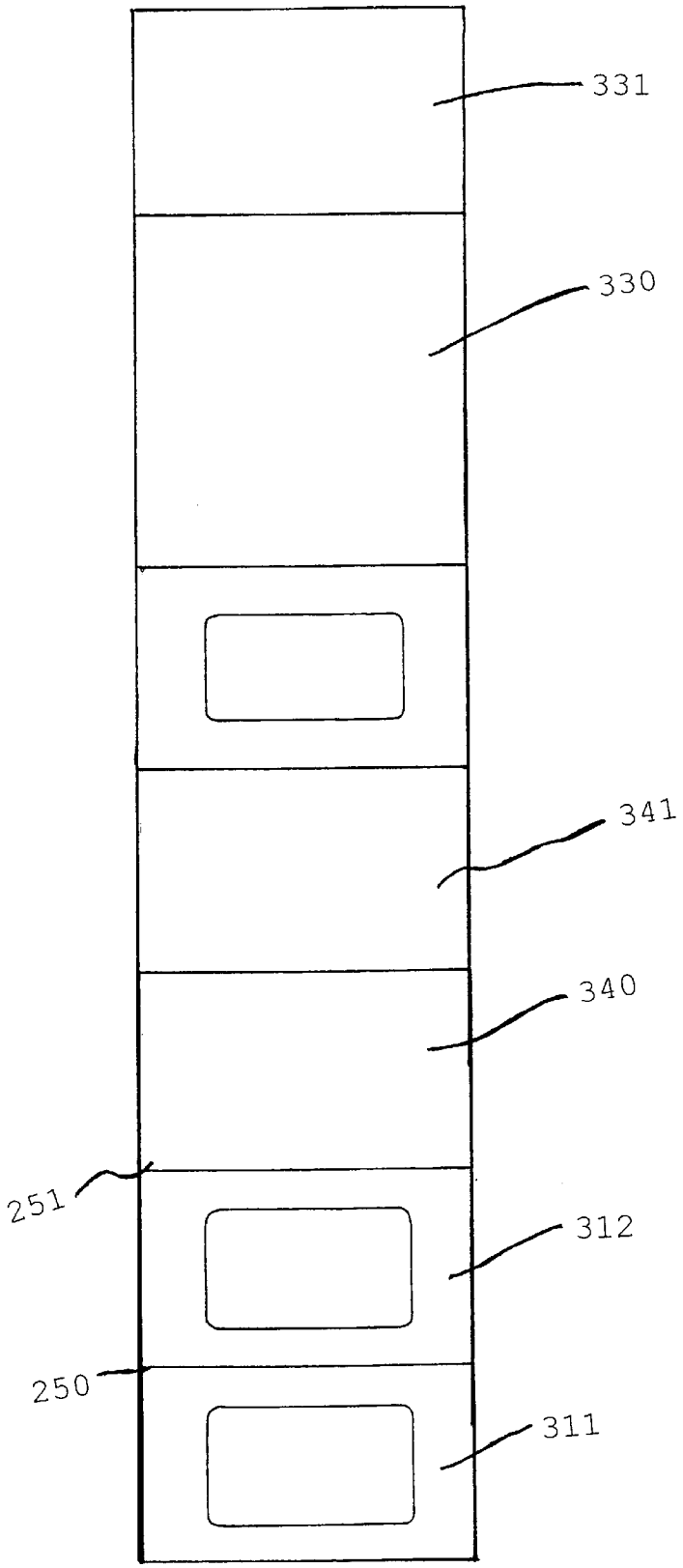
Figure 3E:
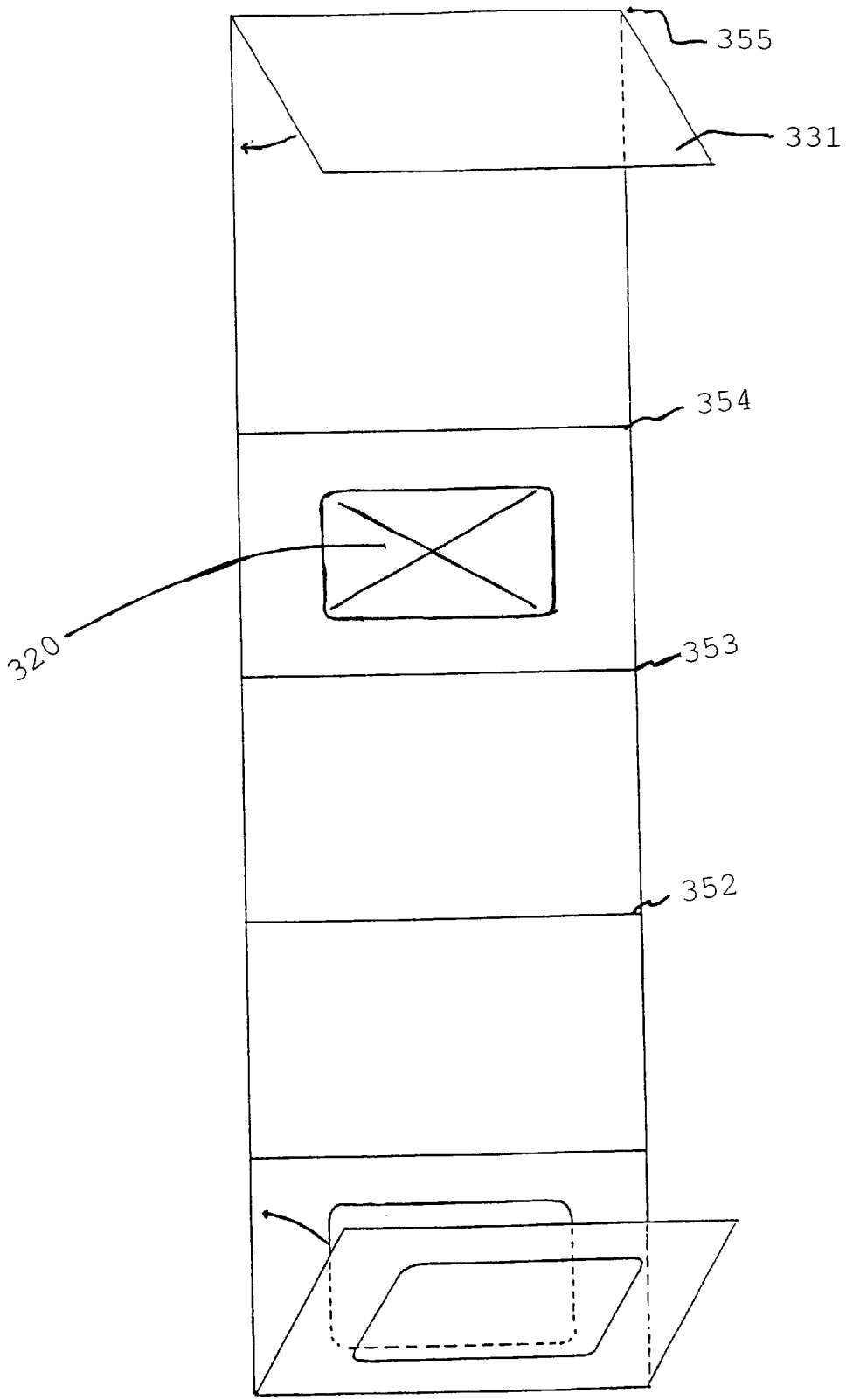
Figure 3F:
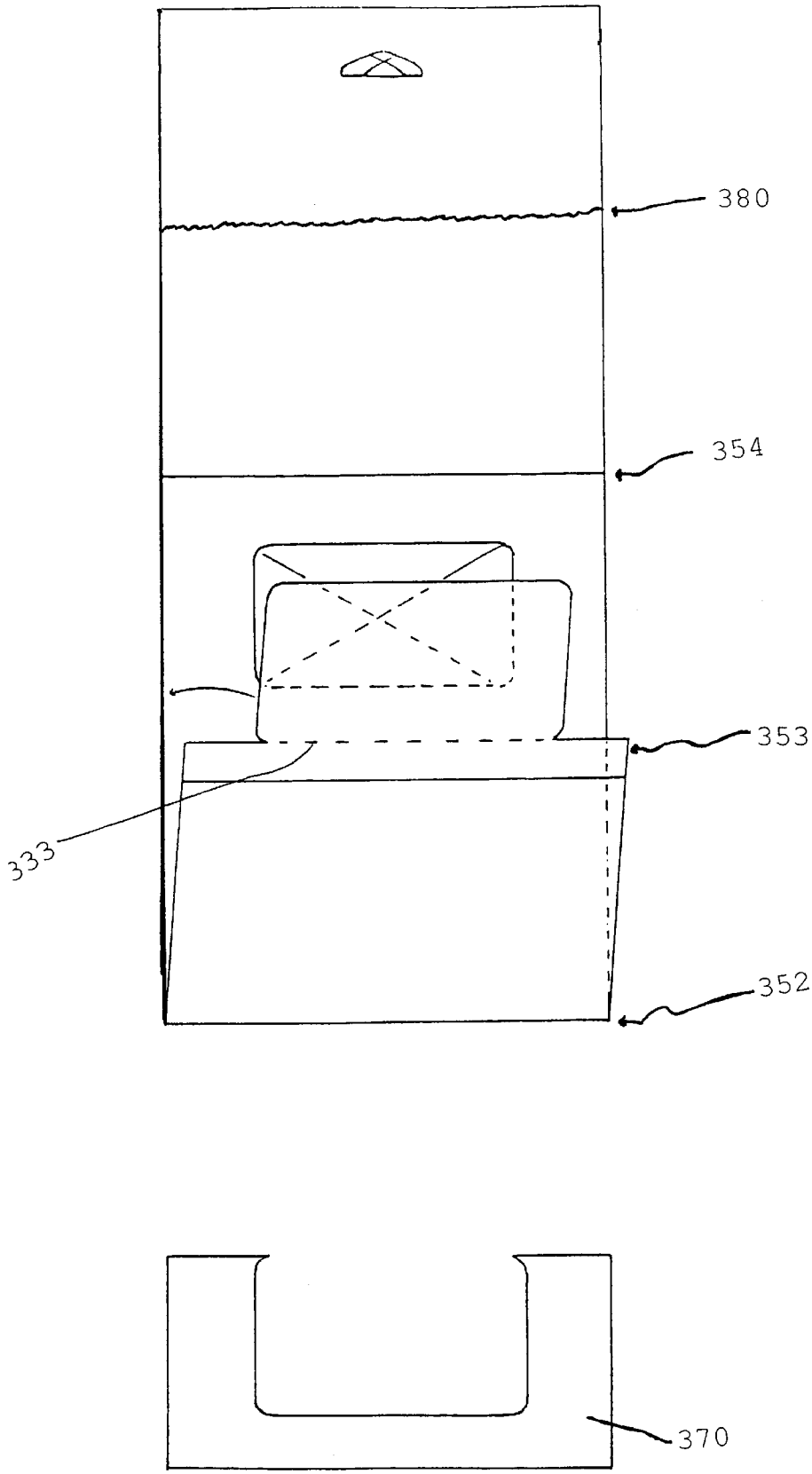

FIGS. 3*d*–3*f* are line diagrams for fabricating the third embodiment of the invention from one contiguous sheet. Two sections 311 and 312 of the contiguous sheet are folded over each other along plow line 250 to form a section of double thickness. More or less sections may be folded over depending on the thickness desired. Section 370 is die cut and removed thus forming a card section 310 having a stiffness greater than the rest of the sheet because of its double thickness. The edge attaching the card to the contiguous sheet has a perforation 333 to facilitate removal of the card by the customer.

The contiguous sheet is folded along plow lines 352, 353 and 354. The front of the package is formed from a cover panel 331 and a back panel 330 folded over each other along plow line 355. Plow lines 351, 352 and 353 may be perforated if panels 340 and 341 are coupons to allow for easy separation of the coupons. The package is sealed by a line of clean release glue 380.

Figure 4A:
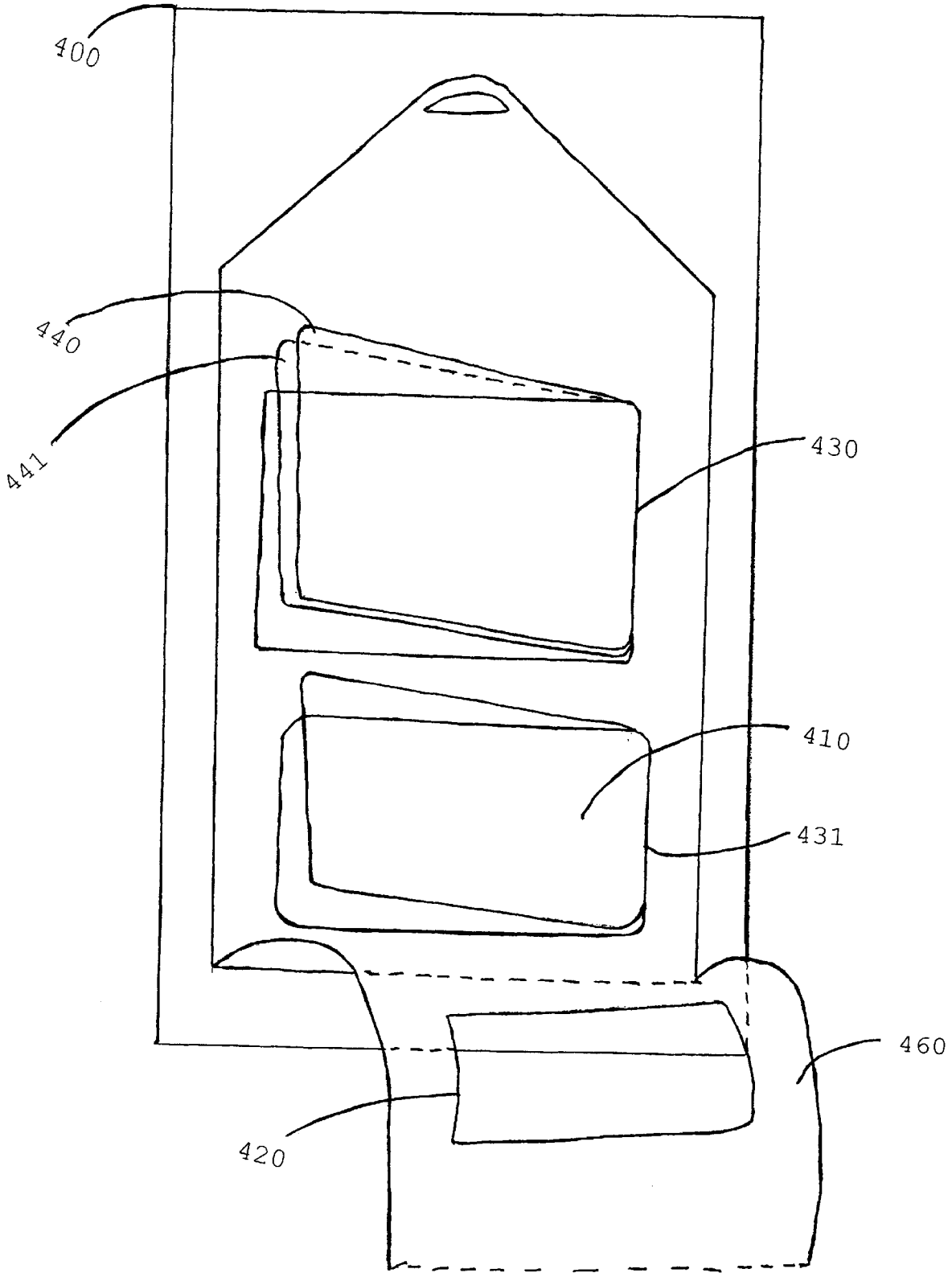
FIGS. 4*a*–4*e* are schematic illustration of a fourth embodiment of the integrated card and packaging according to this invention, and line diagrams for its fabrication.

FIG. 4*a* is the front face view of the final form of the fourth embodiment of this invention an open position. The package 400 has flap 460 covering a card 410 and optional coupons 440 and 441. The flap has an window opening 420 through which the card is visible. The card 410 and coupons are attached to the package at least one edge; the point of attachment having perforations 430 and 431 to facilitate removal of the card and coupon by the customer.

Figure 4B:
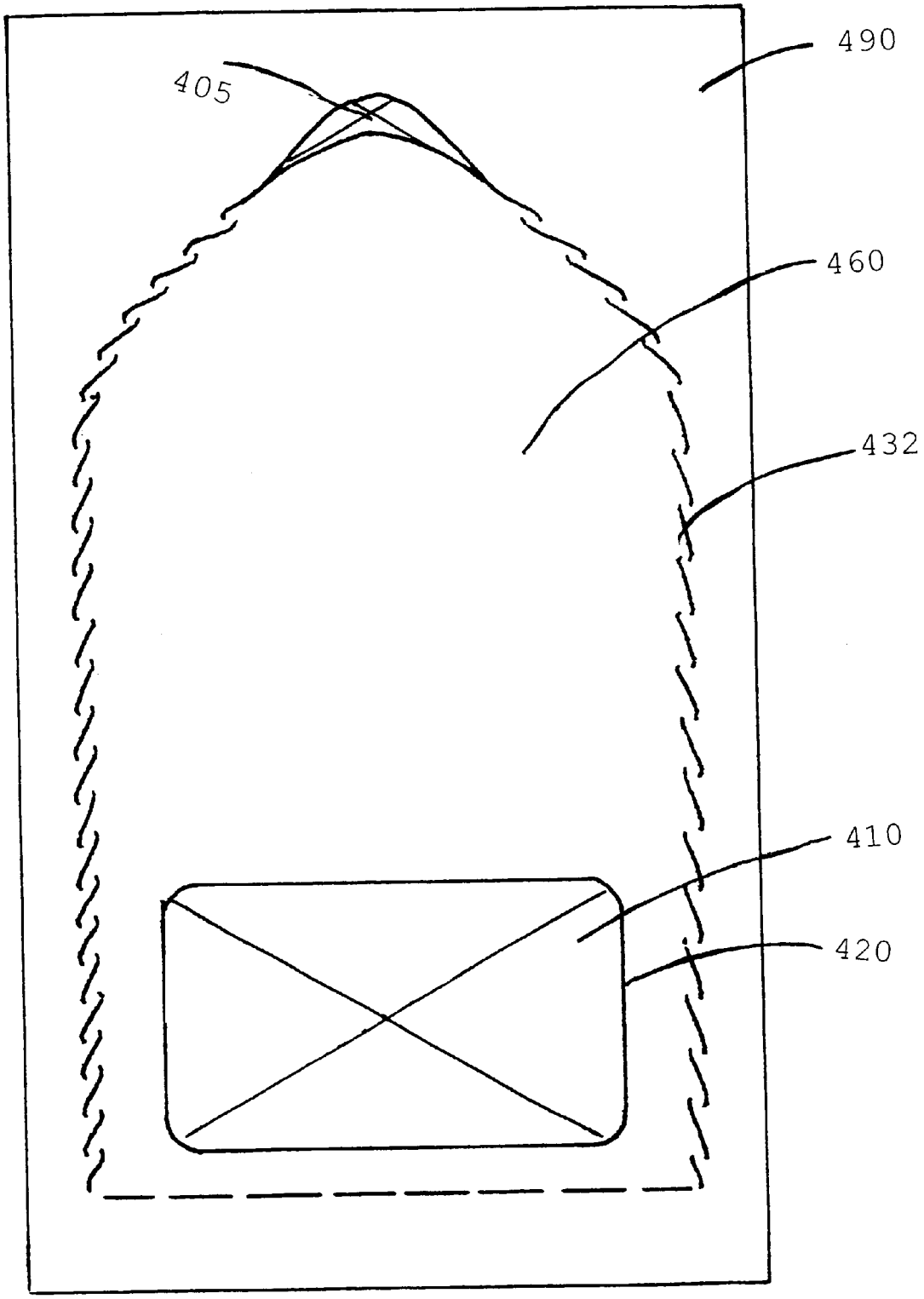

FIG. 4*b* is the front face of the fourth embodiment in a closed position. The front cover panel 490 has perforations 432 which define the flap 460. In the closed position only the flap 460 is visible and the card 410 is visible through the die cut window opening 420 in the flap. The window opening may have a transparent material covering it. A hanger hole 405 may also be die cut.

Figure 4C:
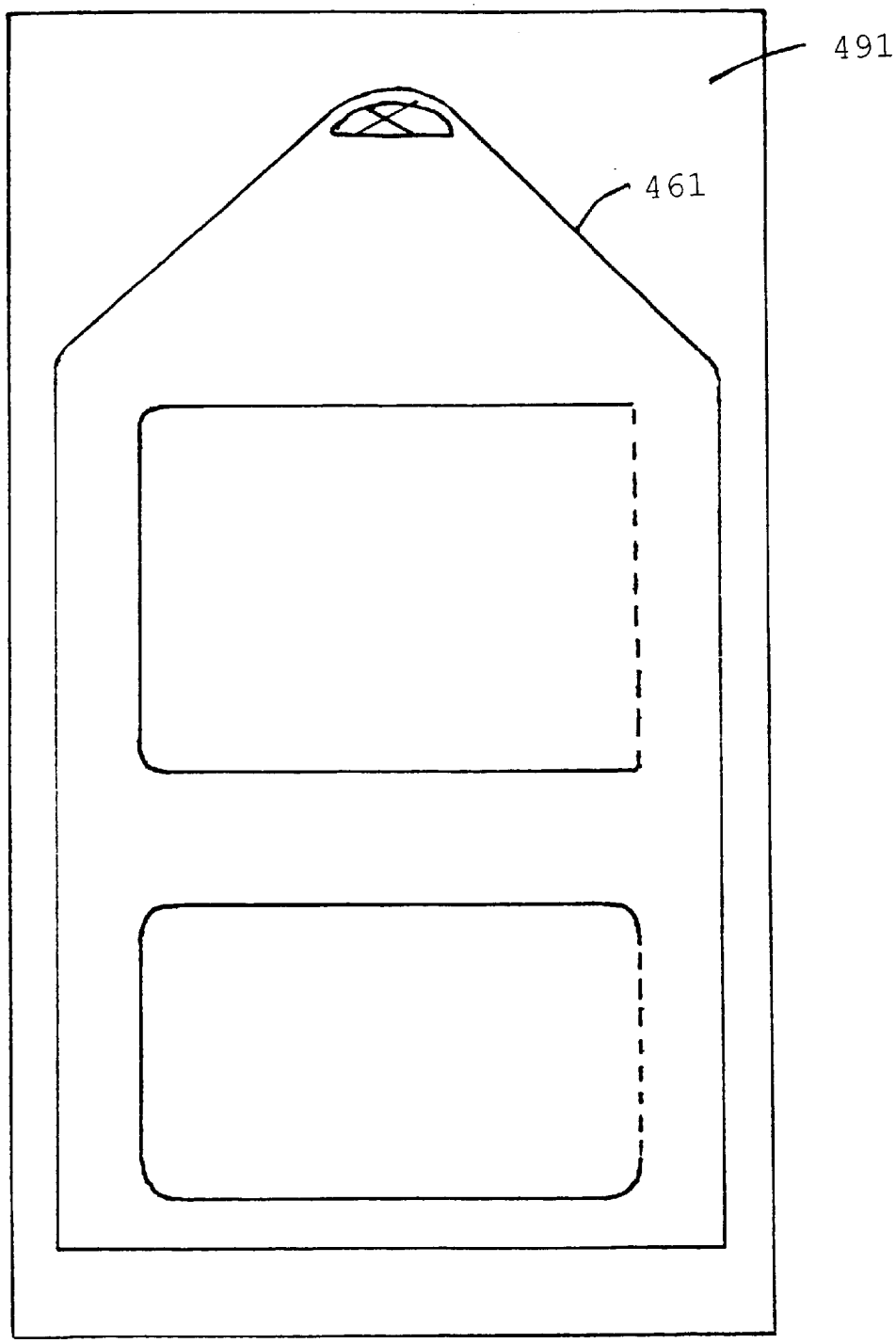

FIG. 4*c* shows the card and coupon panel 491 behind the front cover panel 490. The card and coupon panel 491 may be attached to the back of the front cover panel by glue. The glue, however, is only deposited outside the flap indicator line 461. The card and any coupons are die cut from this panel.

Figure 4D:
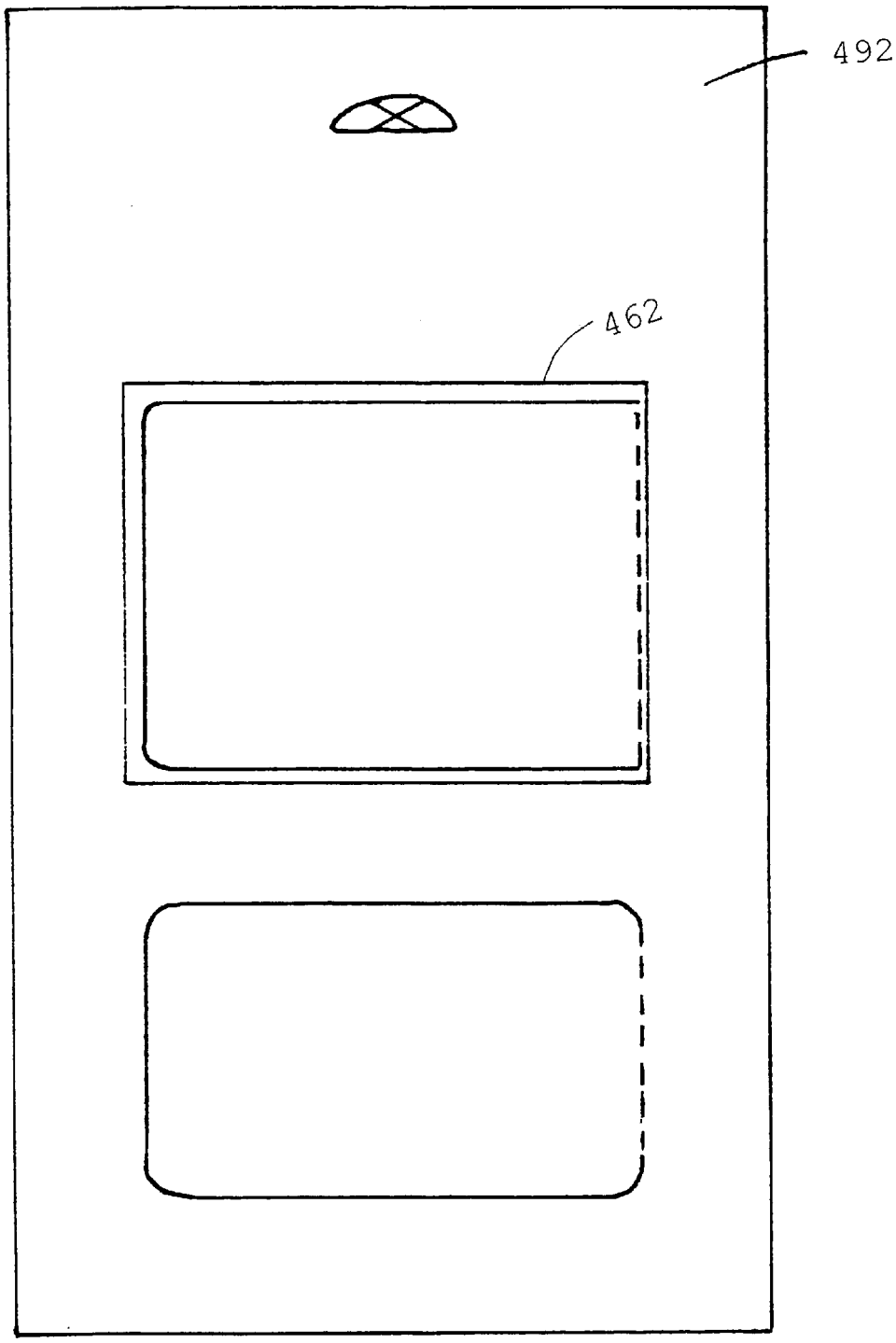

FIG. 4*d* shows the optional second card and coupon panel attached to the back of the card and coupon panel of FIG. 4*c*. If attachment is by means of glue, the glue is deposited outside the coupon area 462. This second card and coupon panel may be used to enhance the thickness and stiffness of the card. In addition, but not necessarily, the second card and coupon panel 492 may be used if more than one coupon is desired in the package. That is, if the first card and coupon panel 491 gives coupon 440 in FIG. 4*a*, the second card and coupon panel 492 gives coupon 441 in FIG. 4*a*. It is thus evident to a skilled artisan that more that the described two card and coupon panels may be used to present a card of desired thickness and/or to present more coupons.

Figure 4E:
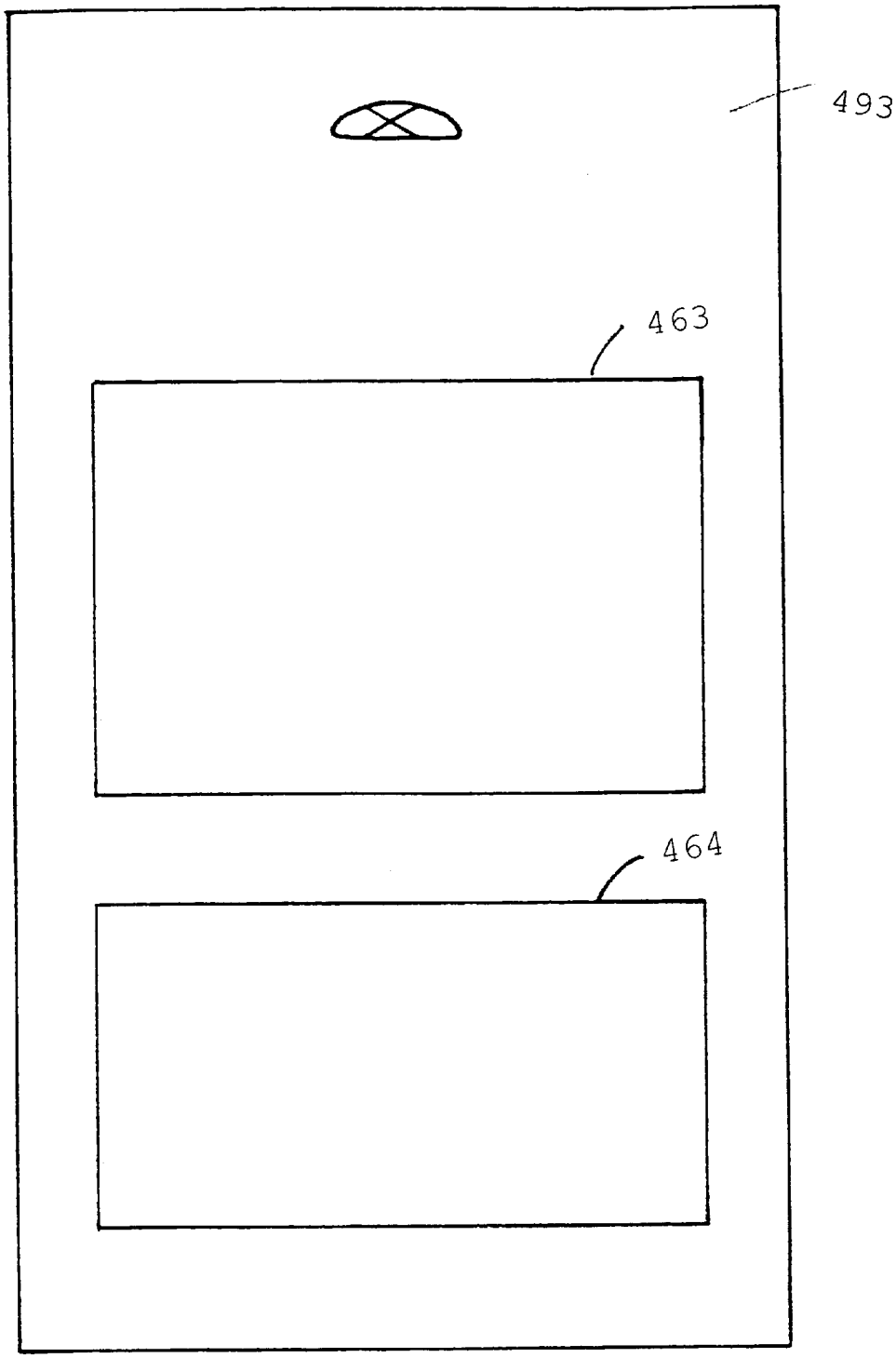

FIG. 4*e* shows the back panel 493 of the fourth embodiment of this invention. The back panel 493 is attached to the back of last card and coupon panel. If the attachment is by means of glue, the points of attachment are outside the coupon area 463 and outside card area 464.

While the invention has been described and shown herein in what is presently conceived to be the most practical and preferred embodiments thereof, it will be readily apparent to those of ordinary skill in the art that many modifications may be made within the spirit and scope of the invention, which scope is to be accorded the broadest interpretation of the appended claims so as to encompass all equivalent assemblies.

What is claimed is:

1. An integrated card and packaging assembly comprising:

a back panel having a front side and a back side;

a card panel attached to the front side of the back panel and having a front side, a back side and a card section; and a cover panel attached to the front side of the card panel and having a section outlined by perforation to constitute a flap larger in area than the area of the card, wherein the card panel has at least one manually detachable card integrally formed therein, and said card and said card panel together define a contiguous sheet of material.

2. The integrated card and packaging assembly of claim 1, wherein the flap in the cover panel comprises a window die cut within the flap and disposed to make the card section of the card panel visible.

3. The integrated card and packaging assembly of claim 1, further comprising at least a second card panel disposed between the card panel and the cover panel.

4. The integrated card and packaging assembly of claim 1, wherein the card panel comprises a coupon section die cut on three of its four edges and perforated on one edge.

* * * * *